United States Patent [19]

Ipek

[11] 3,965,817

[45] June 29, 1976

[54] CLOSED SQUEEGEE APPLICATOR WITH FLEXIBLE SIDES

[76] Inventor: Zeki Ipek, Brahmsgasse 4, A-9020 Klagenfurt, Austria

[22] Filed: Apr. 1, 1974

[21] Appl. No.: 456,768

[30] Foreign Application Priority Data

Apr. 3, 1973 Austria ..... 2922/73

[52] U.S. Cl. ..... 101/120; 101/123; 101/124; 118/205; 118/213; 118/406

[51] Int. Cl.[2] ..... B41F 15/40; B41F 15/44

[58] Field of Search ..... 101/116, 119, 120, 122, 101/123, 124; 118/205, 406, 213; 15/256.5, 256.51

[56] References Cited

UNITED STATES PATENTS

| | | | |
|---|---|---|---|
| 3,776,185 | 12/1973 | Kawasaki | 101/119 |
| 3,804,011 | 4/1974 | Zimmer | 101/120 |
| 3,890,896 | 6/1975 | Zimmer | 101/119 |
| 3,921,520 | 11/1975 | Zimmer | 101/120 |

FOREIGN PATENTS OR APPLICATIONS

| | | | |
|---|---|---|---|
| 2,101,085 | 10/1971 | Germany | 101/120 |

*Primary Examiner*—Edgar S. Burr
*Assistant Examiner*—R. E. Suter
*Attorney, Agent, or Firm*—Wenderoth, Lind & Ponack

[57] ABSTRACT

A stencil printing, coating or coloring machine has a flexible hollow metal cylinder in contact with the stencil, and a perforate strip in the area of contact between the stencil and cylinder. The ends of the cylinder are sealed by deformable covers, and the interior of the cylinder is at least partially filled with printing, coating or coloring material.

3 Claims, 2 Drawing Figures

CLOSED SQUEEGEE APPLICATOR WITH FLEXIBLE SIDES

BACKGROUND OF THE INVENTION

The invention relates to an apparatus for printing, coating or coloring webs by means of flat or cylindrical-stencil printing machines.

The printing, coloring or coating of webs by means of flat or cylindrical stencils requires devices with which the printing ink or the coating material is introduced uniformly over the entire stencil width and reaches the web through the perforations in the stencil.

Depending on the quality of the web material, the stencil must in this connection contact the web intimately or only slightly or be arranged at a distance from the web.

When cylindrical stencils are used, the peripheral velocity thereof must equal the velocity of the web during a printing operation, but the two velocities may differ during coloring or coating operations.

There are known a series of devices whose purpose is to achieve the above. In particular, there are employed slit and chamber squeegees.

Such slit and chamber squeegees consist basically of a hollow element provided with a slit and filled with ink or coating material. The open slit of these slit or chamber squeegees, which extends through the entire working width, contacts the stencil and must be sealed in relation thereto, so that no ink can escape and form an undesirable uncontrolled ink wedge in front of the chamber squeegee. Especially in chamber squeegees that are in the form of a tube and wherein (as described and illustrated in the French patent 1,116,729) liquid pressure is obtained by means of a communicating container, the sealing with sealing lips is a great problem already in the case of small working widths.

Besides, such a hollow element provided with a continuous longitudinal slit is extremely unstable and it is practically impossible to maintain the width of the slit constant without expensive components. Since with a certain quality of web material the amount of ink or coating material applied per unit of surface is a function of the width of the slit, the pressure of liquid in the ink chamber, the squeegee and the working speed, it is necessary to provide devices that take these problems into account.

SUMMARY OF THE INVENTION

The object of the invention is to produce a device which provides the possibility of exact dosing of the ink or coating material through the entire width of the web to be treated and at the same time prevents the uncontrolled emergence of ink.

The invention achieves this object by providing a flexible metal hollow cylinder, which may be an electrolytically formed nickel cylinder, contacting the interior of the stencil and filled at least in part with ink or coating material, which cylinder is perforated along a strip extending in its zone of contact in the direction of its longitudinal axis, its ends being sealed with flexible covers.

The weight of the ink or coating material within the hollow cylinder effects a deformation of the latter, so that the cylinder is pressed closely to the stencil. Now, if the zone of contact between the stencil and cylinder is so selected that it is at least as wide as the width of the perforate strip, there is obtained an efficient sealing effect, and uncontrolled emergence of ink is prevented. In the case of a hollow cylinder whose perforate strip possesses a given width, the zone of contact and thus sealing can be regulated by varying the liquid pressure in the cylinder.

The device of the invention also guarantees the constant width of the passage opening for the ink through the entire width of the web and to an extent that could not be obtained with prior devices. However, the maintenance of a constant width is of decisive importance for obtaining a uniform coating.

BRIEF DESCRIPTION OF THE DRAWINGS

The invention will be explained in more detail below with reference to the drawings.

DETAILED DESCRIPTION OF THE INVENTION

Figure 1:
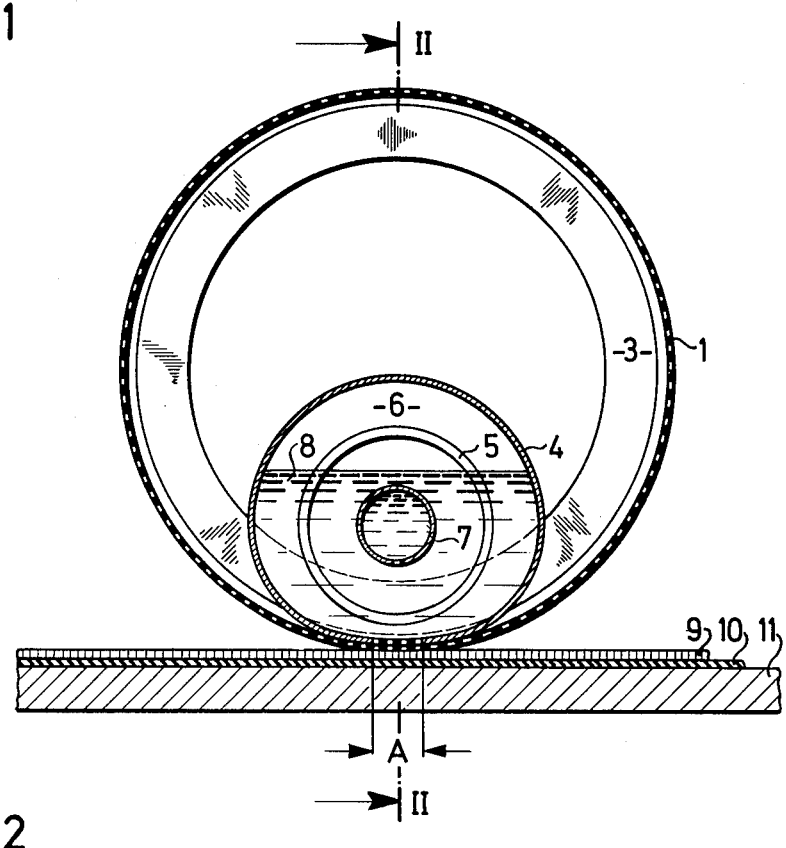
FIG. 1 is a transverse section of a device of the invention.
Figure 2:
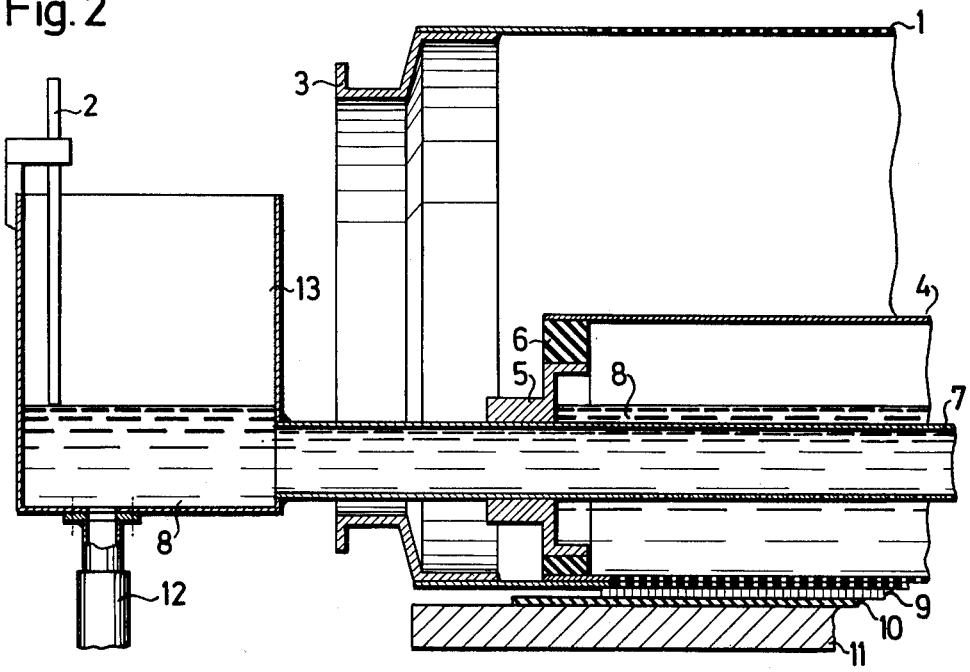
FIG. 2 is a longitudinal section taken along line II—II of FIG. 1.

A blanket 10, on which a web 9 is situated, is pulled over a table 11, over which a cylindrical stencil 1 contacting web 9 is rotated. Cylindrical stencil 1, provided in a customary manner with end pieces 3, contains the application device of the invention, which consists basically of a flexible hollow cylinder 4, end pieces 5 and an ink tube 7. Hollow cylinder 4 possesses a perforate strip extending substantially through the entire length thereof and having a width "A." The cylinder is connected to end pieces 5 by means of readily deformable elastic spacers 6. An ink or coating material 8 is supplied through a pipe 12 to an ink container 13, which is equipped with a level-sensing device 2. Ink tube 7 passing through the end pieces 5 connects the ink container 13 to the application device, so that ink 8 reaches the interior of cylinder 4.

In the case of coloring or coating, cylinder 4 is turned so that the perforate strip is situated in the lowermost position thereof and, owing to gravity, the ink can reach web 9 through the perforate strip and the stencil. The weight of the ink deforms cylinder 4 which is thus pressed closely against the inner surface of cylindrical stencil 1. In order to avoid anything that may counteract such a close contact, elastic spacers 6 are required. Of course, this effect occurs also in the case of flat stencils, wherein however it is desirable to provide a greater diameter of the hollow cylinder and/or a greater amount of ink therein. In order to provide the possibility of an effective sealing between hollow cylinder 4 and stencil 1, the distance of the axis of hollow cylinder 4 from the lowest generatrix of stencil 1 must be smaller than the radius of undeformed cylinder 4. However, this distance also may be not selected too small in order to prevent a practically nonelastic seating of end rings 5 on stencil 1. This occurs when the elastic spacers 6 are compressed to a maximum extent when such distance is too small. The width of the contact zone between hollow cylinder 4 and stencil 1 can be regulated by changing the level of liquid in cylinder 4, in which connection, however, the contact zone must at least be as wide as the width A of the perforate strip.

I claim:

1. In a web printing, coating or coloring apparatus of the type having a stencil mounted for applying printing, coating or coloring material therethrough onto a web, the improvement comprising:

a flexible hollow metal cylinder, the interior of said cylinder being at least partially filled with a supply of said material;

said cylinder having a portion of the periphery thereof deformed by the weight of said contained material and being thereby pressed into contact with said stencil on the interior surface thereof opposite said web;

said cylinder periphery being perforated along a longitudinally extending strip in the area of contact between said cylinder and said stencil;

the peripheral width of said area of contact being at least as great as the peripheral width of said perforate strip; and deformable members sealing the opposite ends of said cylinder.

2. The improvement claimed in claim 1, further comprising an ink supply tube extending through at least one of said members.

3. The improvement claimed in claim 1, wherein said cylinder comprises an electrolytically formed nickel cylinder.

* * * * *